United States Patent [19]

Meunier

[11] Patent Number: 4,926,853

[45] Date of Patent: May 22, 1990

[54] GAS MASK NOSE OCCLUDER

[75] Inventor: Pierre P. Meunier, Nepean, Canada

[73] Assignee: Her Majesty the Queen in Right of Canada, as represented by the Minister of National Defence of Her Majesty's Canadian Government, Ottawa, Canada

[21] Appl. No.: 213,263

[22] Filed: Jun. 29, 1988

[30] Foreign Application Priority Data

Jan. 21, 1988 [CA] Canada ..... 557060

[51] Int. Cl.[5] ..... A62B 7/00

[52] U.S. Cl. ..... 128/201.18; 128/206.23

[58] Field of Search ..... 128/201.15, 201.24, 128/206.21, 206.23, 201.18, 201.12

[56] References Cited

U.S. PATENT DOCUMENTS

| | | | |
|---|---|---|---|
| 276,699 | 5/1883 | McIntosh | 128/201.18 |
| 690,663 | 1/1902 | Pratt | 128/201.18 |
| 1,978,994 | 10/1934 | Fortunato | 128/201.18 |
| 2,108,256 | 2/1938 | Dym | 128/206.23 |
| 3,004,535 | 10/1961 | Nielson | 128/201.12 |
| 3,266,490 | 8/1966 | Klinger et al. | 128/201.18 |
| 3,747,599 | 7/1973 | Malmin | 128/201.12 |
| 4,231,359 | 11/1980 | Martin | 128/201.18 |
| 4,294,243 | 10/1981 | Ernsting et al. | 128/206.21 |
| 4,452,240 | 6/1984 | Moretti | 128/201.18 |
| 4,667,667 | 5/1987 | Schnoor et al. | 128/201.18 |

FOREIGN PATENT DOCUMENTS

| | | | |
|---|---|---|---|
| 2047545 | 12/1980 | United Kingdom | 128/201.18 |

*Primary Examiner*—Edgar S. Burr
*Assistant Examiner*—Huong Q. Pham
*Attorney, Agent, or Firm*—William R. Hinds

[57] ABSTRACT

An improvement to a face mask is disclosed which has two eyepieces, a pliable full face covering, breathing means and means for sealing and securing the mask to the face of a wearer. The improvement being nose occluding means which include a pair of prong members made of a rigid material. Each prong member is adjustably attached at one end thereof to a lower rim portion of a respective eyepiece at an angle with respect thereto so that it is directed inwardly toward the nose of the wearer. A method of nose occlusion in order to perform the valsalva maneuvre utilizing the improved face mask is also disclosed.

3 Claims, 2 Drawing Sheets

GAS MASK NOSE OCCLUDER

FIELD OF THE INVENTION

This invention relates generally to face or gas masks and more specifically to face or gas masks that are adapted to allow the valsalva manoeuvre to be performed.

The valsalva manoeuvre is used to equilibrate the internal air pressure in the sinus cavities and ears with the atmospheric pressure. This is done by blocking or occluding the nose and then attempting to exhale through it. This manoeuvre is essential in aircrew applications.

SUMMARY OF THE INVENTION

This invention is particularly adapted for use with gas masks, however, it can be readily used with many types of face masks in situations where the valsalva manoeuvre must be performed, such as in firefighting in a high rise building.

Very few gas masks are adapted to allow valsalva. Some have mechanisms to pinch the nose while others have an area where pitching can be done through the facepiece rubber directly by the fingers. Unfortunately, these methods of carrying out valsalva are not adaptable to many gas mask designs.

The present invention provides an inexpensive and indirect means of allowing the valsalva manoeuvre to be performed through a gas mask without affecting the protection afforded by it. It is readily adaptable to many mask designs, such as the XC4 gas mask in which there is no way to directly access one's nose.

Specifically, this invention provides for an improvement to a face mask which has two eyepieces, a pliable full face covering, breathing means and sealing and securing means for sealing the mask securely to the head of a wearer. The improvement comprises nose occluder means which include a pair of prong members which are each made of a rigid material. These members are each adjustably attached at one end thereof to a lower rim portion of a respective eyepiece at an angle with respect thereto so as to be directed inwardly toward the nose of the wearer.

This invention also provides a method of nose occlusion utilizing the above-described face mask which includes the step of pushing the eyepieces toward the face and thereby causing the prong members to press against the nose and close the nostrils.

BRIEF DESCRIPTION OF THE DRAWINGS

A specific embodiment of the invention is now described in further detail with reference to the drawings in which.

DESCRIPTION OF THE PREFERRED EMBODIMENTS

Figure 1:
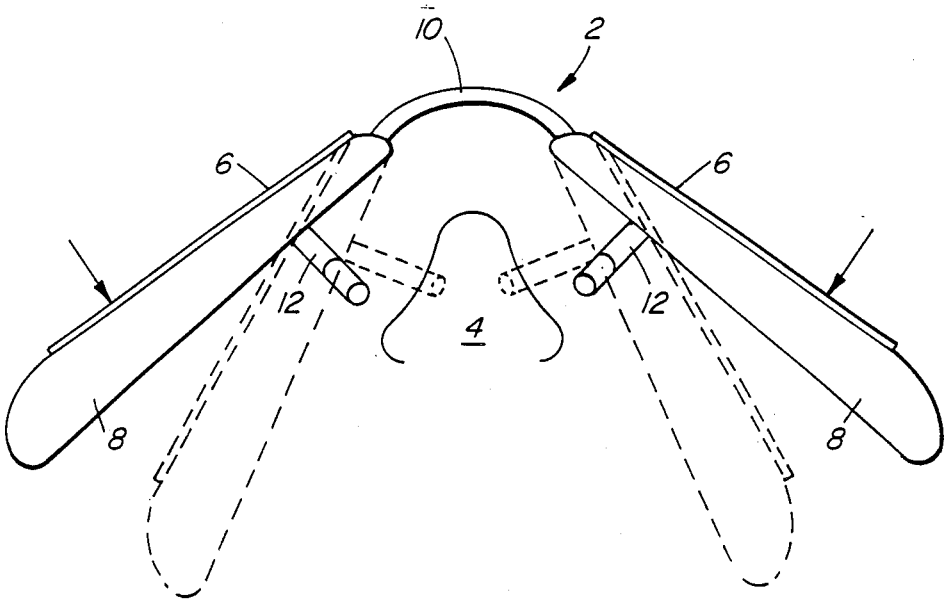
FIG. 1 is a partial plan view of an embodiment of the invention showing its method of operation.

Referring to FIG. 1, part of the gas mask 2 of the preferred embodiment is shown to basically comprise two eyepieces 6 which are each held in place in the mask by rims 8. The sealing and securing means and breathing means are not shown. The face covering is made of rubber and the part which covers the nose 4 of the wearer is designated as 10. Nose occluding prong members 12 are shown to be at an angle with respect to the eyepieces 6 so that they are directed toward the nose 4.

Figure 2:
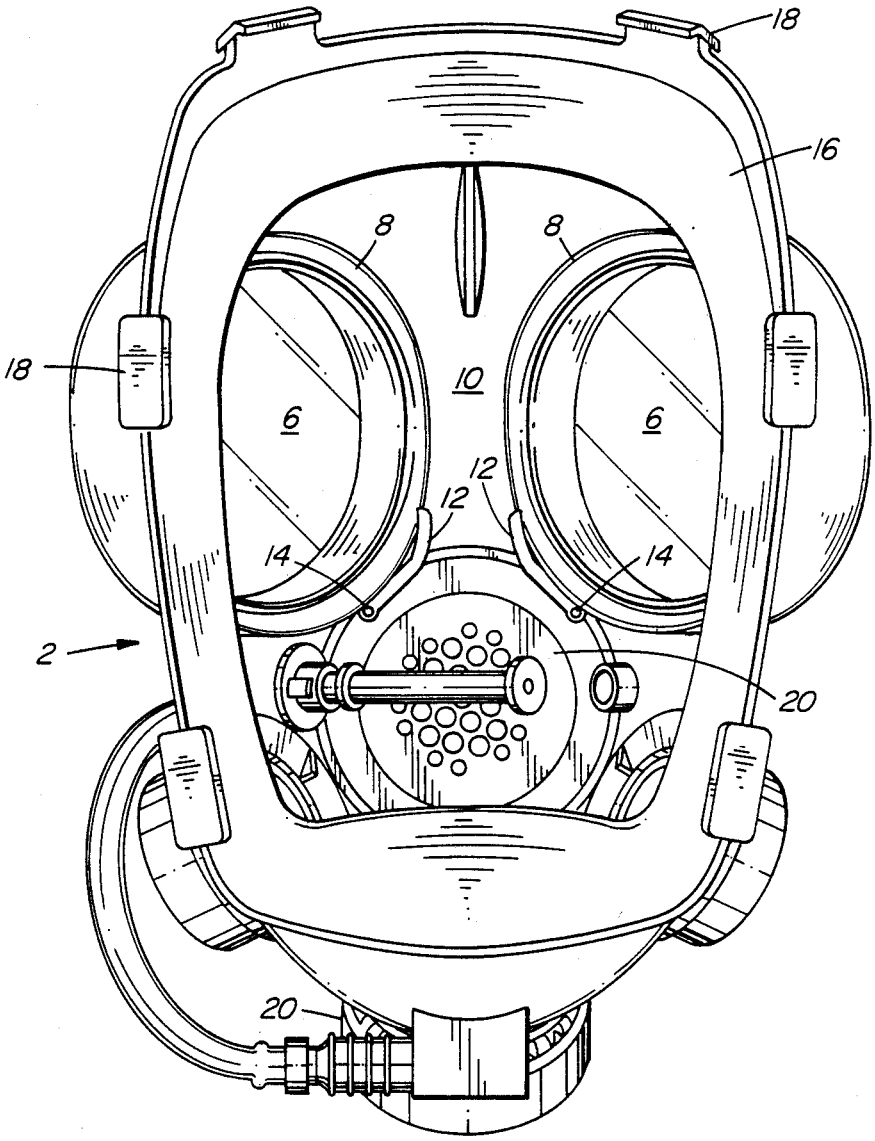
FIG. 2 is an elevation view of the inside of an embodiment of the invention shown in FIG. 1.

Referring to FIG. 2, eyepieces 6 and rims 8 are shown in elvation from the inside of mask 2. The rubber of the facepiece 10 is shown as are the sealing means 16, securing means 18 and breathing means 20. The attachment means 14 of the prong members 12 to the rims 8 is also visible. The prong members 12 are in the shape of a bent cylinder, and each has a hole at one end for pivotable attachment to a lug (not shown) on the lower part of the rims 8 by the attachment means 14, such as a screw. The face ends are rounded so that they do not cause discomfort when the prong members are used to occlude the nose 4 of the wearer. The prong members 12 are adjustable so that they can be adjusted to properly occlude the noses of all sizes of personnel.

The nose occlusion procedure is performed as shown in FIG. 1. The wearer pushes the eyepieces toward the face. This pushing action brings the vertical portions of the prong members 12 into contact with the sides of the nose 4. Nose occlusion occurs when sufficient pressure is applied by the prong members 12 against the nose 4 to close the nostrils.

The embodiments of the invention in which an exclusive property or privilege is claimed are defined as follows:

1. In a face mask having two rigid eyepieces having rims, a pliable full face covering carrying the eyepieces such that the eyepieces can be manually moved toward the face of a user, breathing means and sealing and securing means for sealing the mask securely to the head of a wearer, the improvement comprising nose occluder means including a pair of prong members each made of a material having sufficient rigidity to close the nostrils of a user, said prong members each being adjustably attached at one end thereof directly to an interior lower rim portion of a respective eyepiece at an angle with respect thereto so as to be directed inwardly toward the nose of the wearer, said pliable full face covering enabling said eyepieces to be manipulated toward the face to cause the prong members to press against the nose and close the nostrils.

2. The face mask of claim 1, wherein each of said pair of prong members being of a bent cylindrical shape and having a rounded free end.

3. A method of nose occlusion including providing a face mask having two rigid eyepieces, providing a rim on each of said eyepieces, providing a pliable full face covering carrying the eyepieces such that the eyepieces can be manually moved toward the face of a user, providing breathing means, sealing and securing means for sealing the mask securely to the head of the wearer, providing a nose occluder including a pair of prong members made of material having sufficient rigidity to close the nostrils of a user and adjustably fastening one end of each of said prong members to the interior lower rim of a respective eyepiece at an angle with respect thereto so as to be directed inwardly toward the nose of the wearer, said pliable full face covering enabling said eyepieces to be manipulated toward the face to cause the prong members to press against the nose and close the nostrils, and including the step of pushing said eyepieces toward the face thereby causing said prong members to press against the nose and close the nostrils.

* * * * *